US007503550B2

(12) United States Patent
Liefke

(10) Patent No.: US 7,503,550 B2
(45) Date of Patent: Mar. 17, 2009

(54) ENCLOSED FENCE/RAILING SET

(76) Inventor: Norman William Liefke, 800 15355-24 ave, Surrey, B.C. (CA) V4A 2H9

( * ) Notice: Subject to any disclaimer, the term of this patent is extended or adjusted under 35 U.S.C. 154(b) by 78 days.

(21) Appl. No.: 11/621,786

(22) Filed: Jan. 10, 2007

(65) Prior Publication Data

US 2008/0164451 A1 Jul. 10, 2008

(51) Int. Cl.
*E04H 17/16* (2006.01)

(52) U.S. Cl. ..... 256/24; 256/65.04; 256/65.06; 256/65.14

(58) Field of Classification Search ..... 256/19, 256/21, 22, 24, 59, 65.02, 65.03, 65.04, 65.06, 256/65.14

See application file for complete search history.

(56) References Cited

U.S. PATENT DOCUMENTS 3,037,593 A * 6/1962 Webster ..... 256/24
3,304,683 A * 2/1967 Ferreira ..... 256/65.14
3,776,522 A * 12/1973 Bartlett ..... 256/19
5,695,174 A * 12/1997 Tsai ..... 256/19
5,702,090 A * 12/1997 Edgman ..... 256/19
5,904,343 A * 5/1999 Parth ..... 256/24
5,988,599 A * 11/1999 Forbis ..... 256/24
6,152,428 A * 11/2000 Simioni ..... 256/24
6,478,287 B2 * 11/2002 DeSouza ..... 256/19
2006/0113517 A1 * 6/2006 Colantonio et al. ..... 256/24

FOREIGN PATENT DOCUMENTS

FR 2 571 771 * 10/1985

* cited by examiner

*Primary Examiner*—Daniel P Stodola
*Assistant Examiner*—Michael P Ferguson
(74) *Attorney, Agent, or Firm*—Lowe Hauptman Ham & Berner, LLP

(57) ABSTRACT

An enclosed fence railing set includes a set of posts with tips and fixing components for an upper beam and lower beam on both sides thereof. The fence railing set also includes a set of beams including an upper beam and a lower beam wherein the upper beam and lower beam match the fixing components and wherein there are railings between the sets of beams. A set of stakes are provided for fixing the posts. Each of the stakes includes a tube extending upwardly from the stake and a plate separating the stake and tube with a number of holes in the plate.

6 Claims, 14 Drawing Sheets

ENCLOSED FENCE/RAILING SET

BACKGROUND OF THE INVENTION

1. Field of the Invention

The present invention relates to a set of enclosed fence/railing set, including a set of posts, a set of beams, a set of railings, and a set of stakes, especially a set of enclosed fence or railings which is aluminum extruded. Different parts of the enclosed railing are linked up with one another by tenons for users to easily assemble/dissemble it and put it away. It is light and convenient for transportation. The present invention is also equipped with stakes which enables it to steadily hold the ground. Therefore, when assembled and used on the ground, the present invention is capable of enduring much external stress.

2. Description of the Prior Art

Fences, or railings, became part of our daily lives a long time ago. Living rooms and dining rooms are divided when railings are set up in the house. Railings can also be helpful to the old or the sick, so that they are able to move around. They can also be used to protect babies or young children. Railings are mostly used outside of the house in hallways. As for fences, they are used to create borders. When fences are near to the house, they circle around a yard. When they are farther away from the house, they are used to show where the larger borders are. In addition, they can also prevent captured or domesticated animals from escape or avoid attacks/intrusions from strangers/wild animals.

Most of the existing fences or railings are made of wood. In order to strengthen them, some of them are made of iron or other heavy materials. Nevertheless, whether they are made of wood or iron, they are drilled and then screwed together, and they are heavier as a whole. They are not flexible and hard to transport.

Accordingly, the present invention has been invented to solve the above-mentioned problems occurred in the prior art.

SUMMARY OF THE INVENTION

The present invention provides an enclosed fence/railing set, including a set of posts, a set of beams, a set of railings, and a set of stakes. Said posts, beams, and railings are all aluminum extruded for the convenience of disassembling, assembling, and storage.

Accordingly, an object of the present invention is to provide a set of railing which is capable of enduring much external stress. The stakes of the present invention have spiral lines on the outside, which allows the present invention to drill deep. The stakes are equipped with tubes inside, whereas there are pores on the walls of the tubes. After having filling in soil hardening agent and water in the tubes, the agent spreads to the ground and forms solid materials between the stakes and the ground. Therefore, upon completion of the assembling and stake-setting, the present invention will be capable of enduring external physical impacts.

The above purposes and structure of the present invention will be more apparent from the following detailed description taken in conjunction with the accompanying drawings:

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE PREFERRED EMBODIMENT

Figure 1:
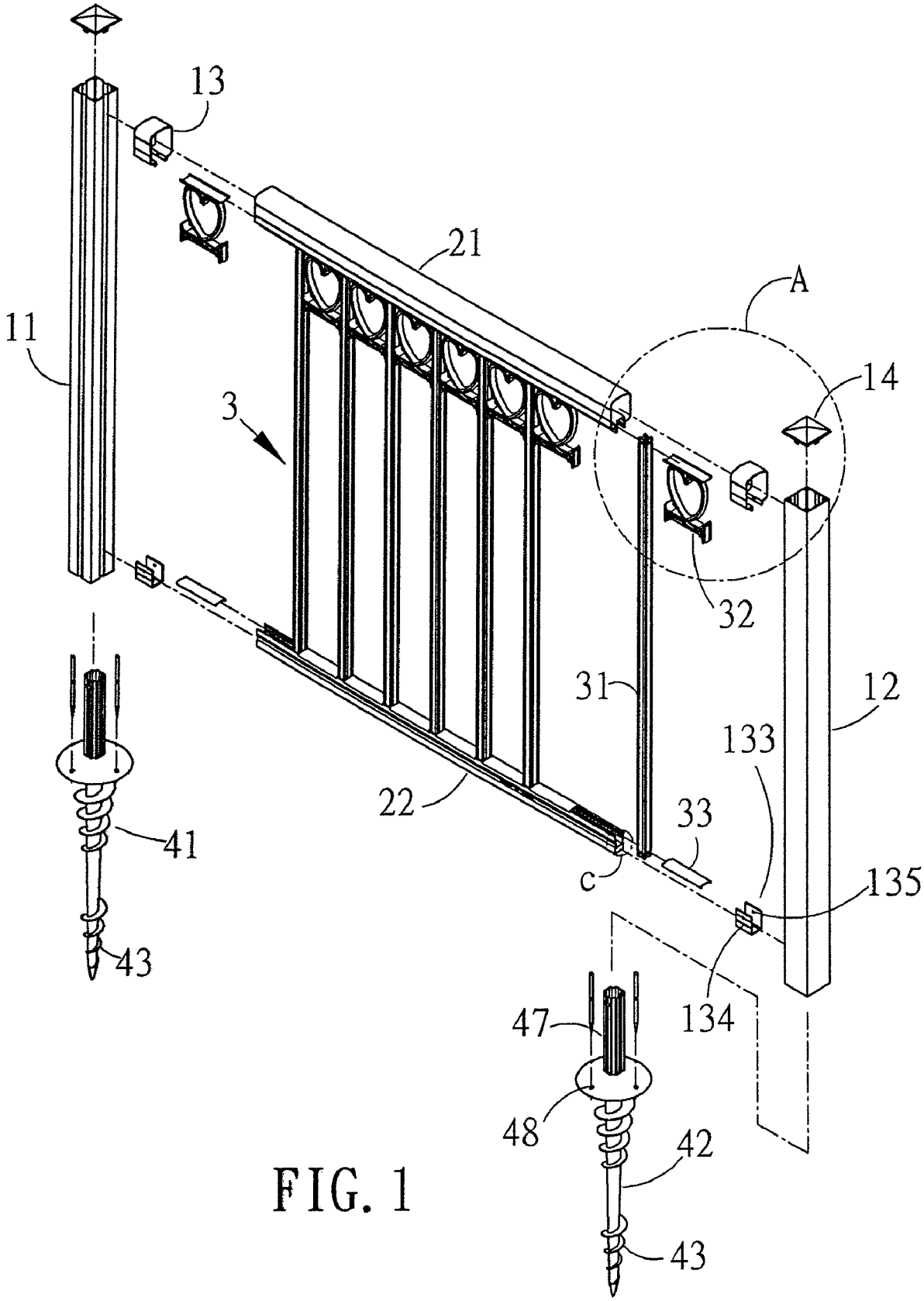
FIG. 1 is a 3-dimensional exploded view of the present invention.
Figure 2:
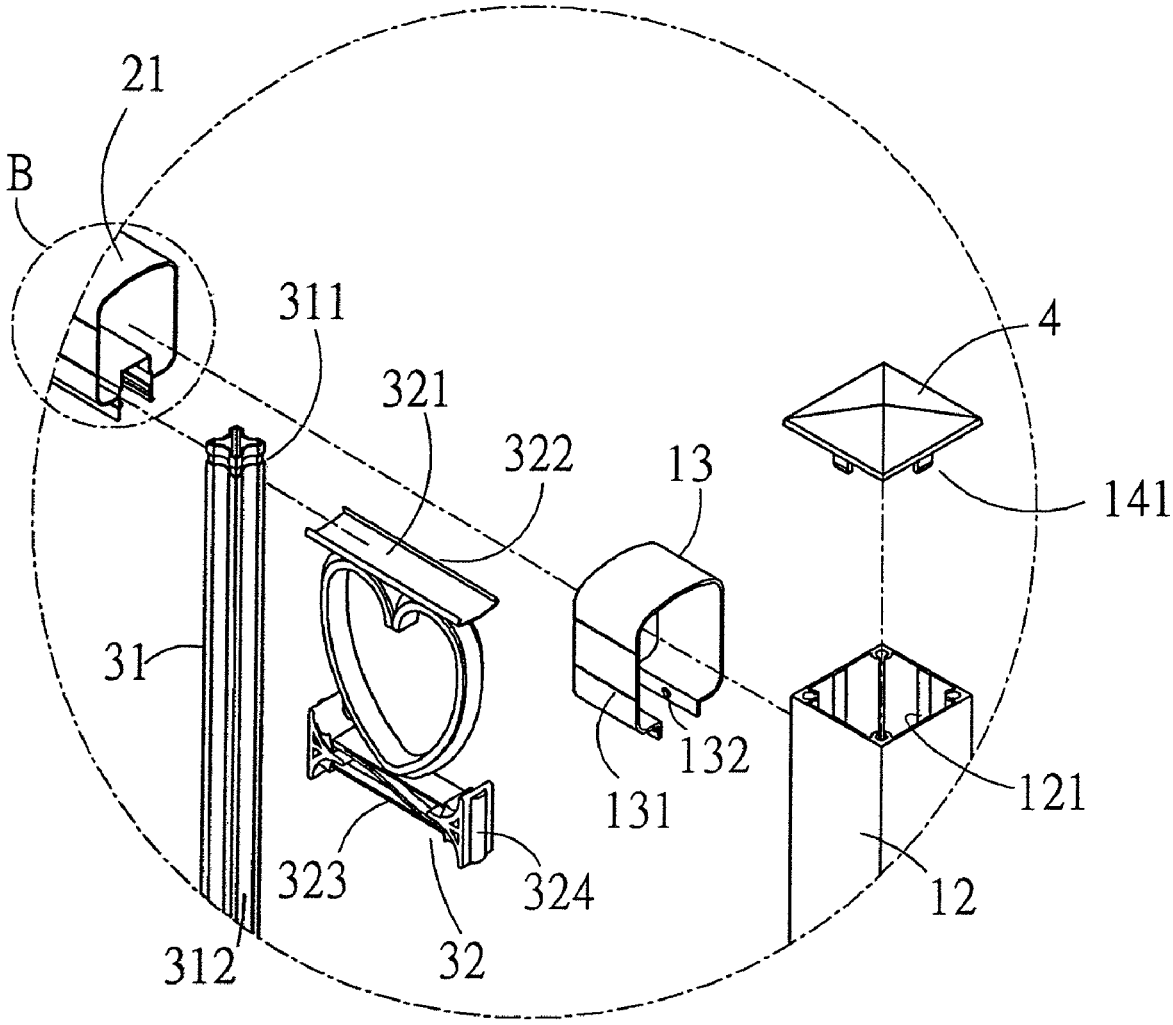
FIG. 2 is an enlarged view of part A in FIG. 1.

The enclosed fence/railing set are shown in FIG. 1, including a set of posts 11 and 12, a set of beams 21 and 22, a set of enclosed railing 3, and a set of stakes 41 and 42; said posts 11 and 12, said beams 21 and 22, and said enclosed railing 3 are all aluminum extruded.

One beam-fixing component 13 is fixed on top of posts 11 and 12. Said beam-fixing component 13 is gate-shaped, with grooves 131 on its exterior wall and fixing hole 132 on its bottom. Fixing hole 132 allows the beams to fit in and then get fixed with screws. One beam-fixing component 133 is fixed on the bottom of posts 11 and 12. Said beam-fixing component 133 is gate-shaped, with groove 134 and fixing hole 135 on its exterior for fixing beams.

One cap 14 is set on top of posts 11 and 12. Said cap 14 can be cone-shaped, round, or in other shapes. One long tenon 141 is set on the bottom of cap 14, so that cap 14 can match itself with groove 121 while assembling.

Figure 3:
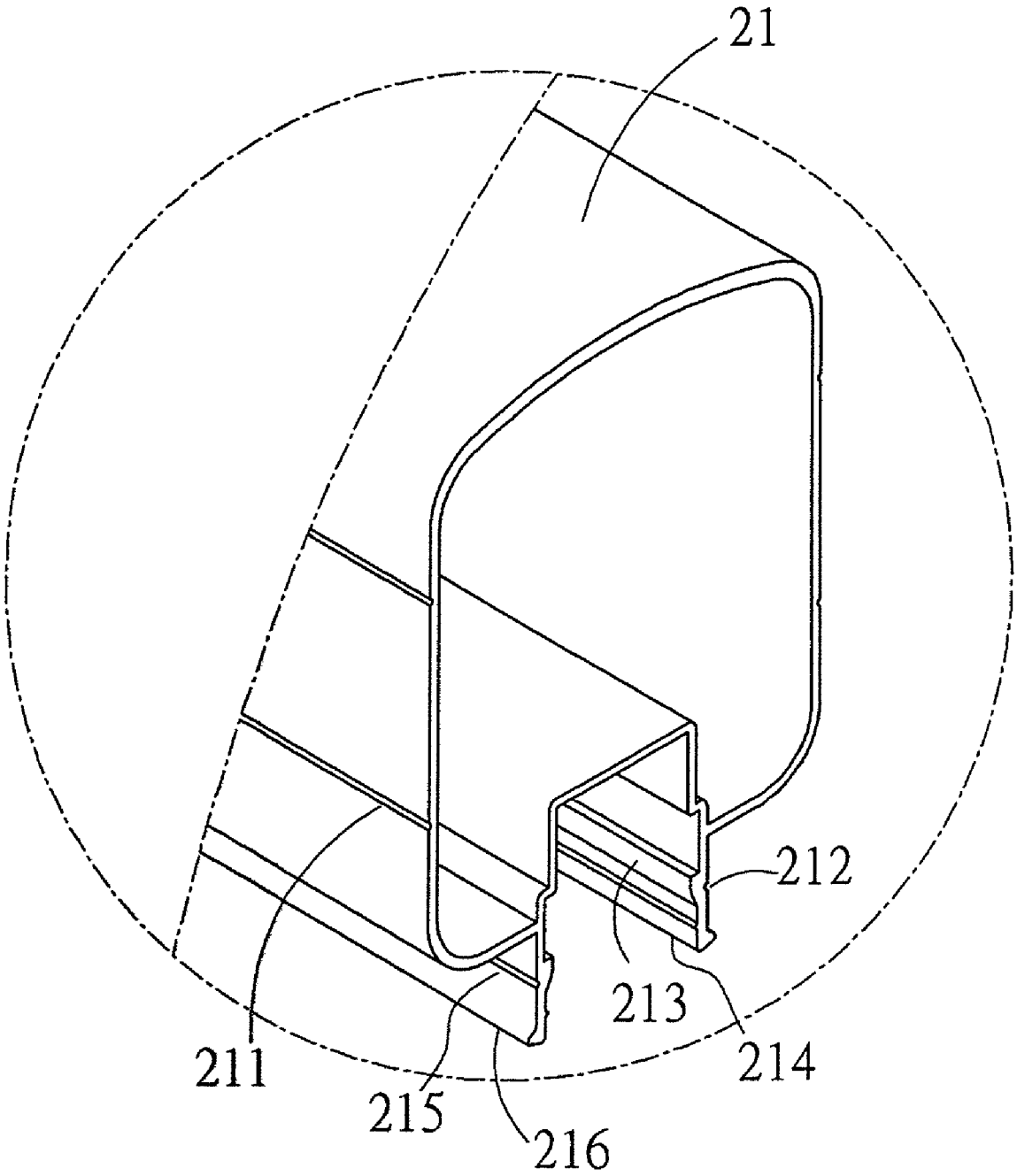
FIG. 3 is an enlarged view of part B in FIG. 2.

Said beams 21 and 22 are respectively the upper beam 21 and the lower beam 22 as shown in FIG. 3. Said upper beam 21 is a square tube with grooves on its exterior. One plate 212 lies on the bottom of it, with tenon 213 and protruding tip 214 on its interior. Groove 215 and tilting brim 216 are on the exterior of plate 212.

Figure 4:
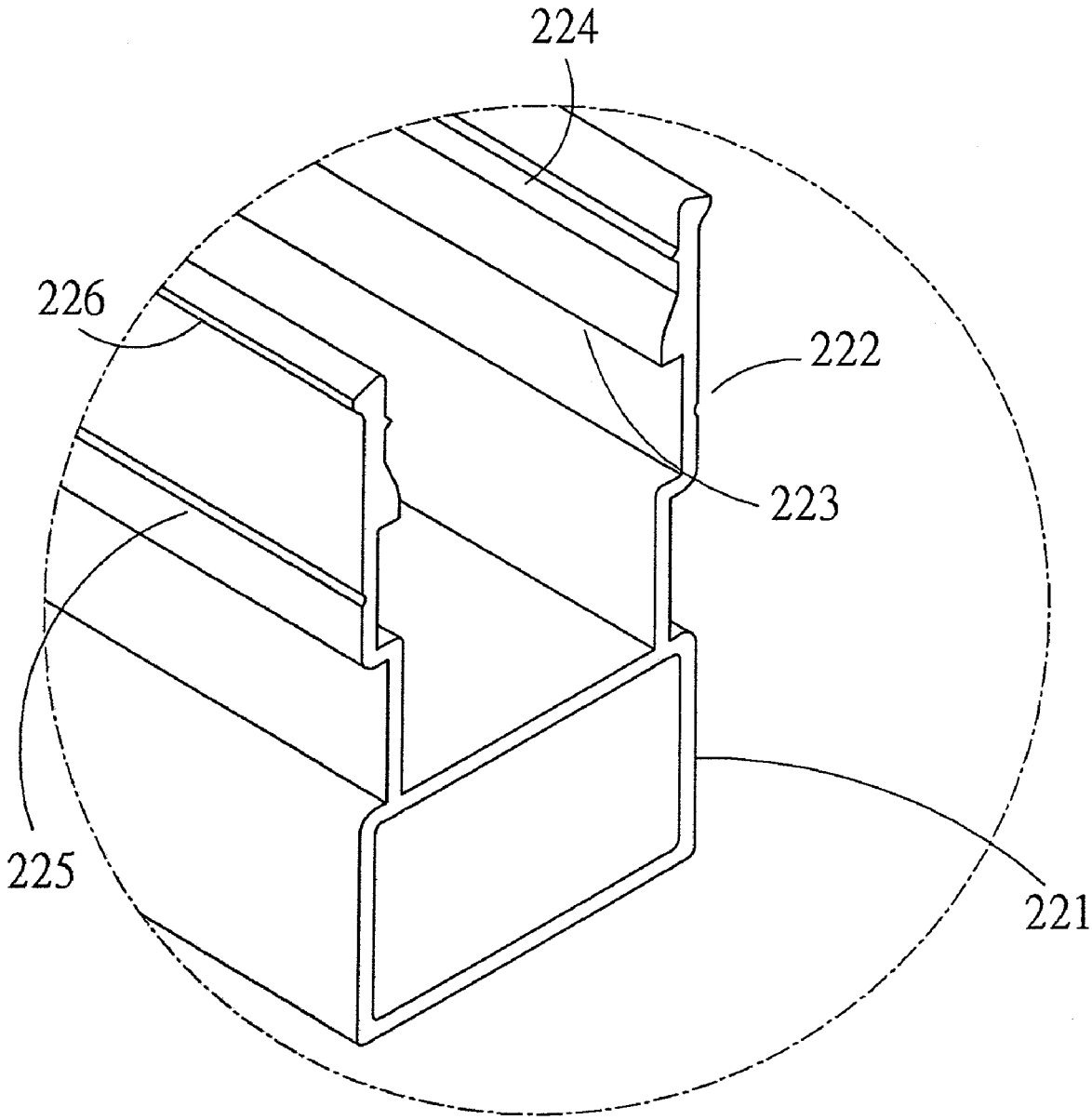
FIG. 4 is an enlarged view of part C in FIG. 2.

As shown in FIG. 4, said lower beam 22 has a plate 222 that matches the plate of the upper beam. There is one long tenon 223 and one protruding tip 224 on the interior of said lower beam and one groove 225 and tilting brim 226 on its exterior.

As shown in FIG. 3, said railing is set between upper beam 21 and lower beam 22, including stick 31 and small plate 32. A surrounding groove 311 lies on both tips of stick 31, which allows it to match with long tenon 213 of the upper beam and the lower beam. Small plate 32 is linked with a connecting plate 321.

Said small plate 32 is connected to a connecting plate 321 with its upper part; there are folds 322 on two sides of connecting plate 321, allowing plate 321 to be fixed to long tenon 213 of said upper beam and move along the inner side of said beam.

One separating strip 323 is set below small plate 32, and on both sides of said separating strip are arch-shaped post 324. When small plate 32 is set between separating posts 31, it can be fixed to arch-shaped groove with said matching post 324.

Within lower beam 22 and between two separating posts, another separating plate 33 is set.

Figure 5:
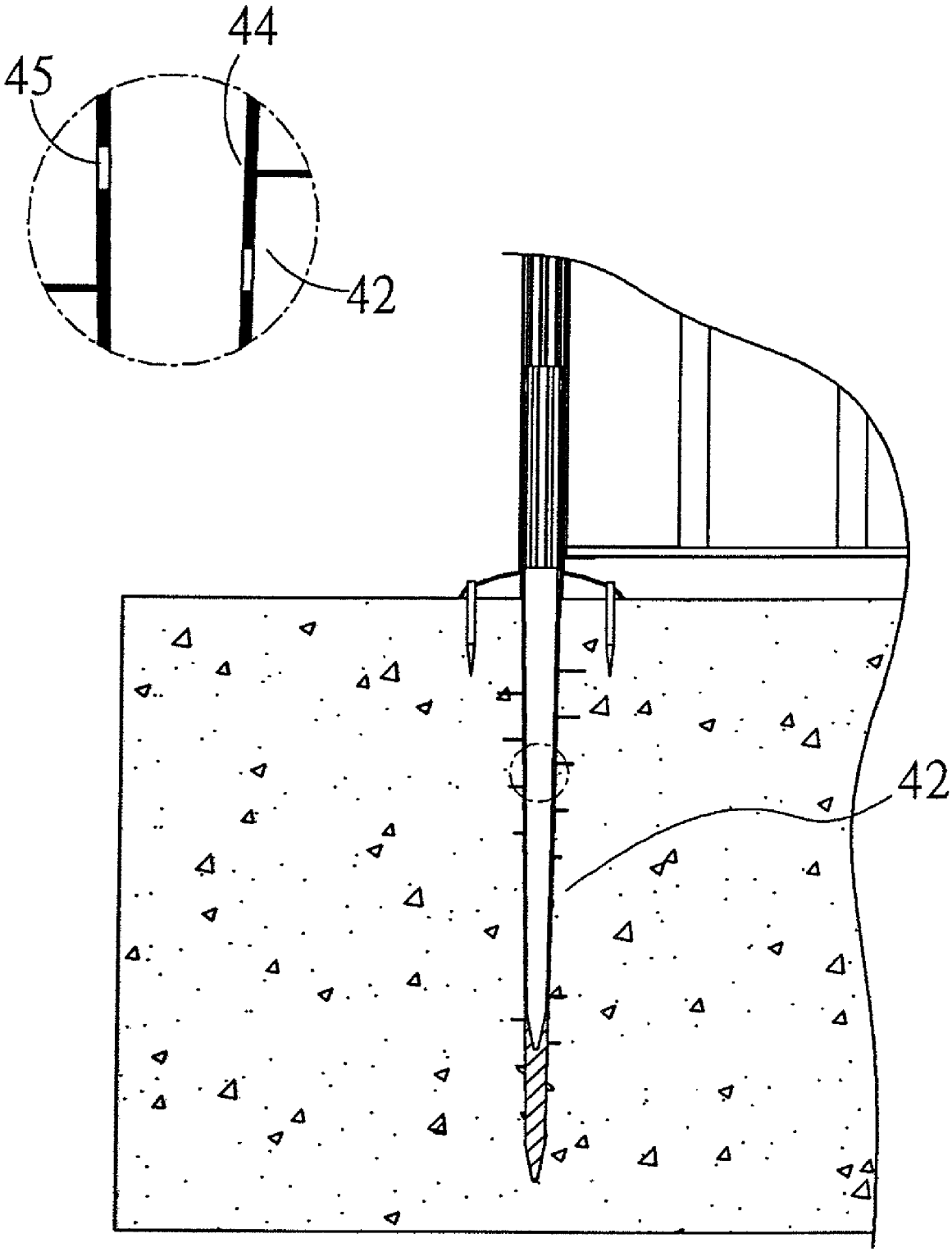
FIG. 5 is a sectional view of a stake of the present invention.

The above mentioned stakes 41 and 42 are as shown in FIG. 5. There are spirals 43 on the exterior of said stakes 41 and 42, an inner tube 44, and holes 45. Hole 45 are linked with inner tube 44. When fixed stakes 41 and 42 to the ground, soil hardening agent (which can be either powder or liquid) and water shall be filled following on. Said agent shall flow into the ground along with water through holes 45. Then, said stakes will be firmly fixed to the ground and form a solid foundation.

As shown in FIG. 1, multi-angular tubes 47 are set on top of stakes 41 and 42, with a round plate 46 fixed between said tube 47 and stakes 41 and 42. This enables the stakes to be tightly fixed to posts 11 and 23. Holes 48 on plate 46 are for the convenience of placing nails in.

Figure 6:
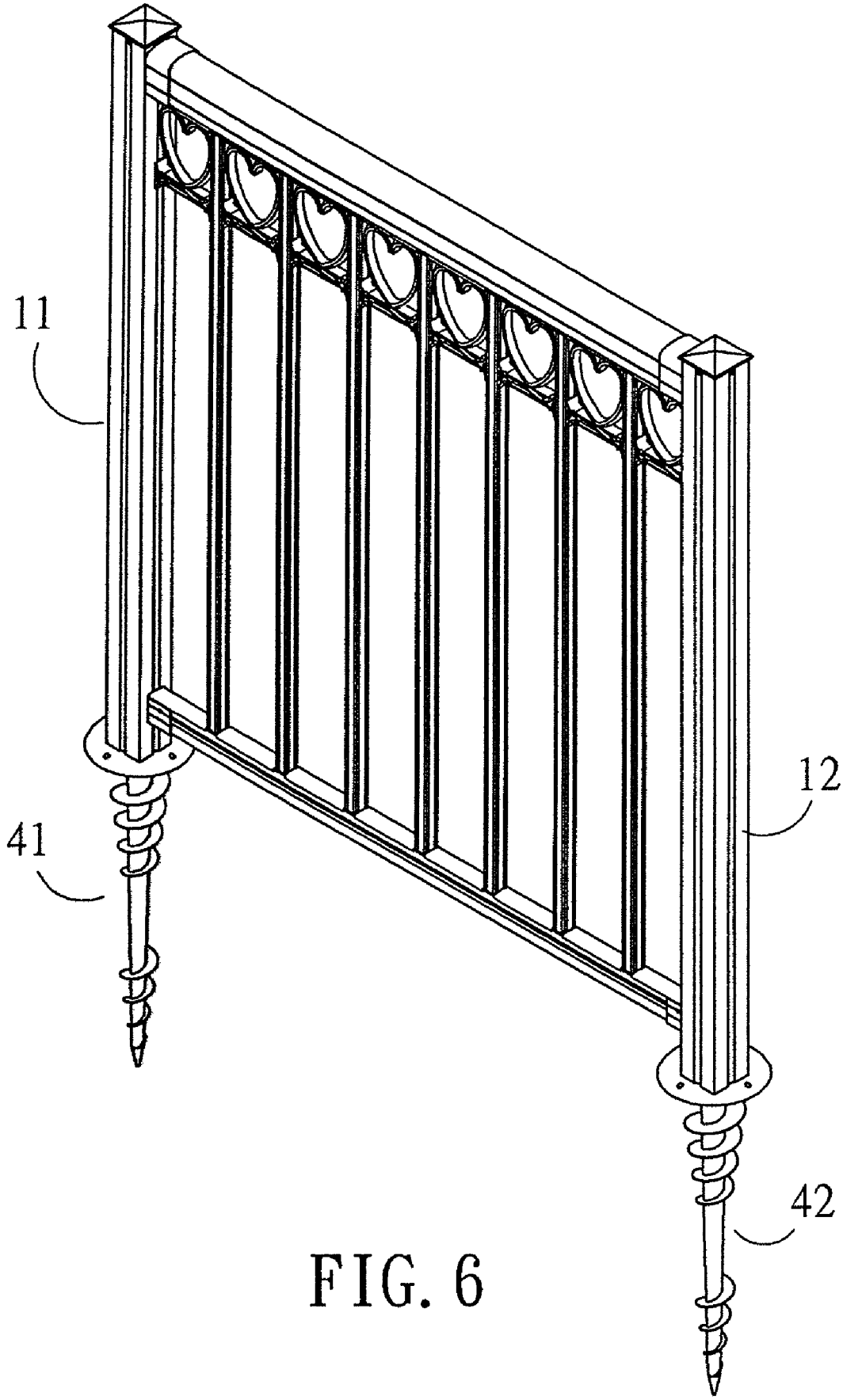
FIG. 6 is a 3-dimensional unified view of the present invention.

Upon complete assembling, a railing is set as shown in FIG. 6. Said railing is not only equipped with stakes that hold the ground tightly, but it is very convenient to transport/assemble/dissemble because it is aluminum extruded. The soil hardening agent filler design, moreover, allows the set to be fixed solidly to the ground and can be used depending on various types of ground.

Figure 7A:
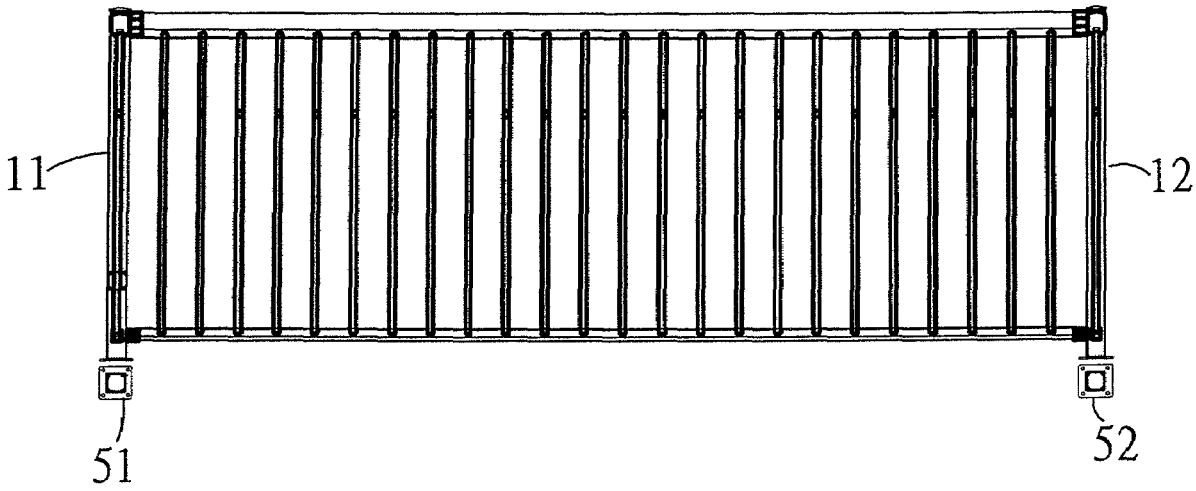
FIG. 7A is a plan view of the second embodiment of the present invention.
Figure 7B:
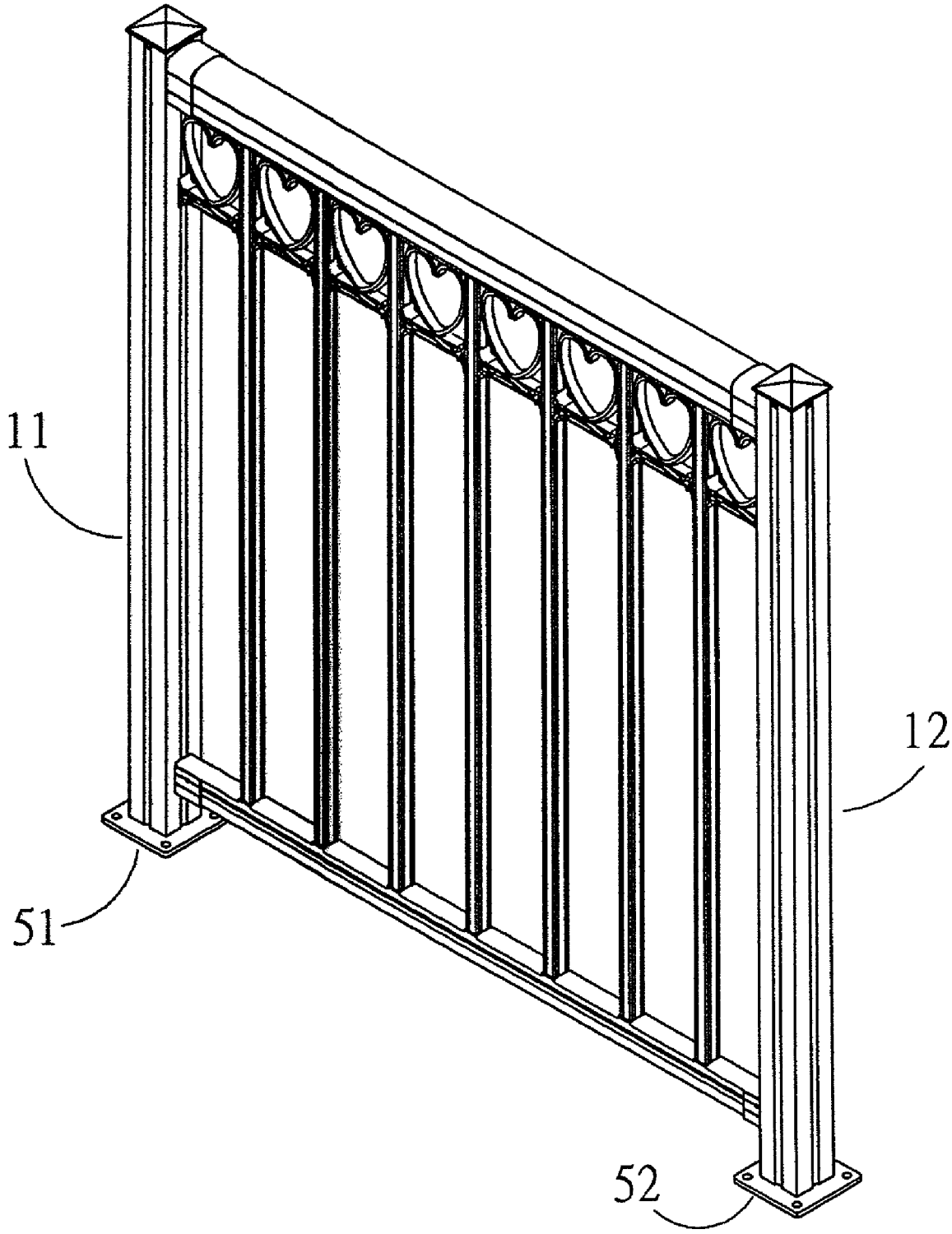
FIG. 7B is a 3-dimensional unified view of the second embodiment of the present invention.

As shown in FIGS. 7A and 7B, said enclosed fence/railing set can also do without stakes 41 and 42. With square bottom plates 51 and 51, posts 11 and 12 can also be fixed to non-soil ground (for example, wooden floor).

Figure 8:
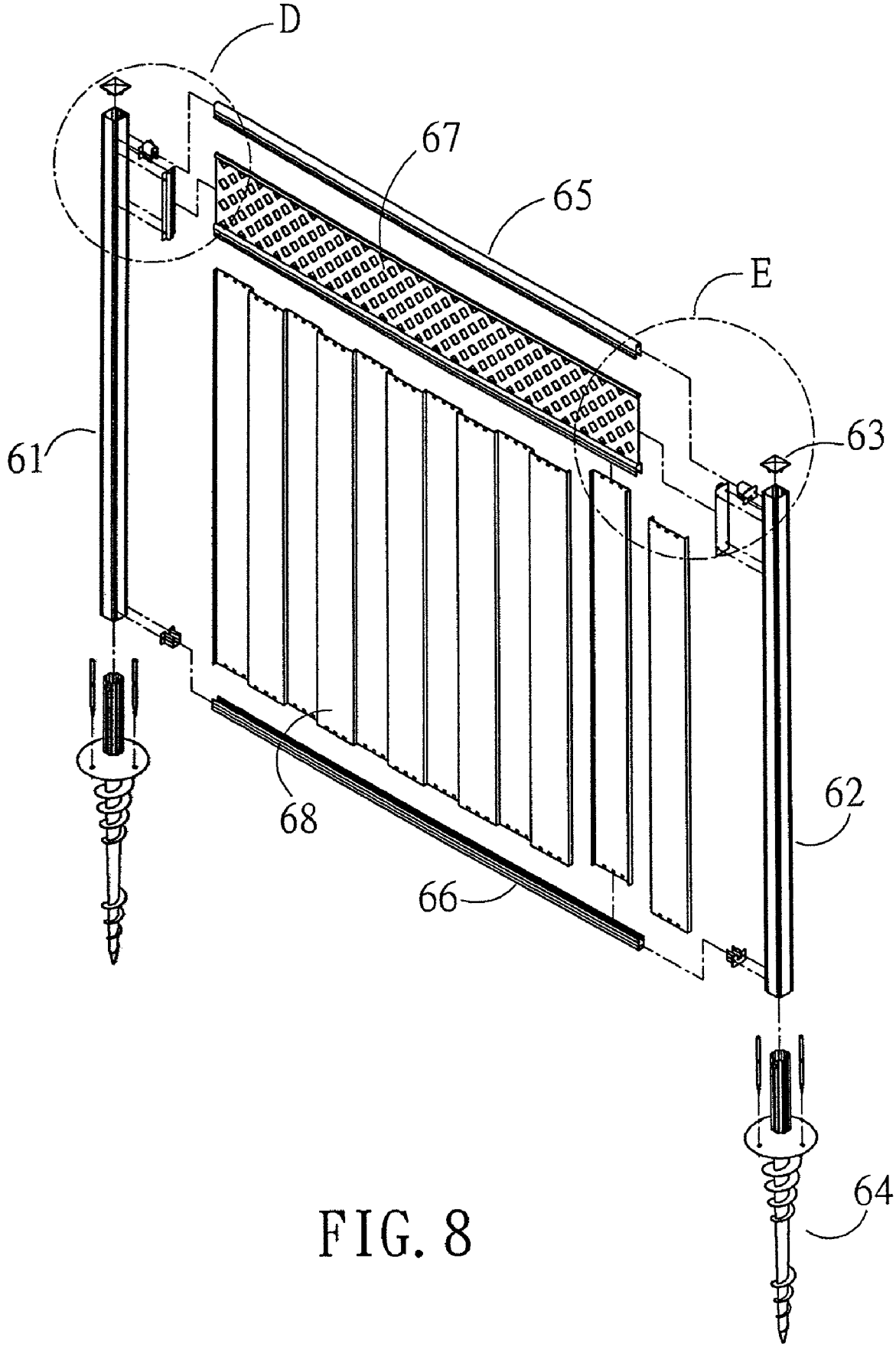
FIG. 8 is an exploded view of the third embodiment of the present invention.

As shown in FIG. 8, said enclosed fence/railing set can also be complemented with check plate 67 and covering plate 68 between the upper and lower beams to make compartment in households.

As shown in FIG. 8, caps 63 can be fixed on top of posts 61 and 62, whereas stakes 64 can be fixed below. Upper beam 65 and lower beam 66 are placed between posts 61 and 62, whereas check plate 67 and covering plate 68 are placed between upper beam 65 and lower beam 66.

Figure 9:
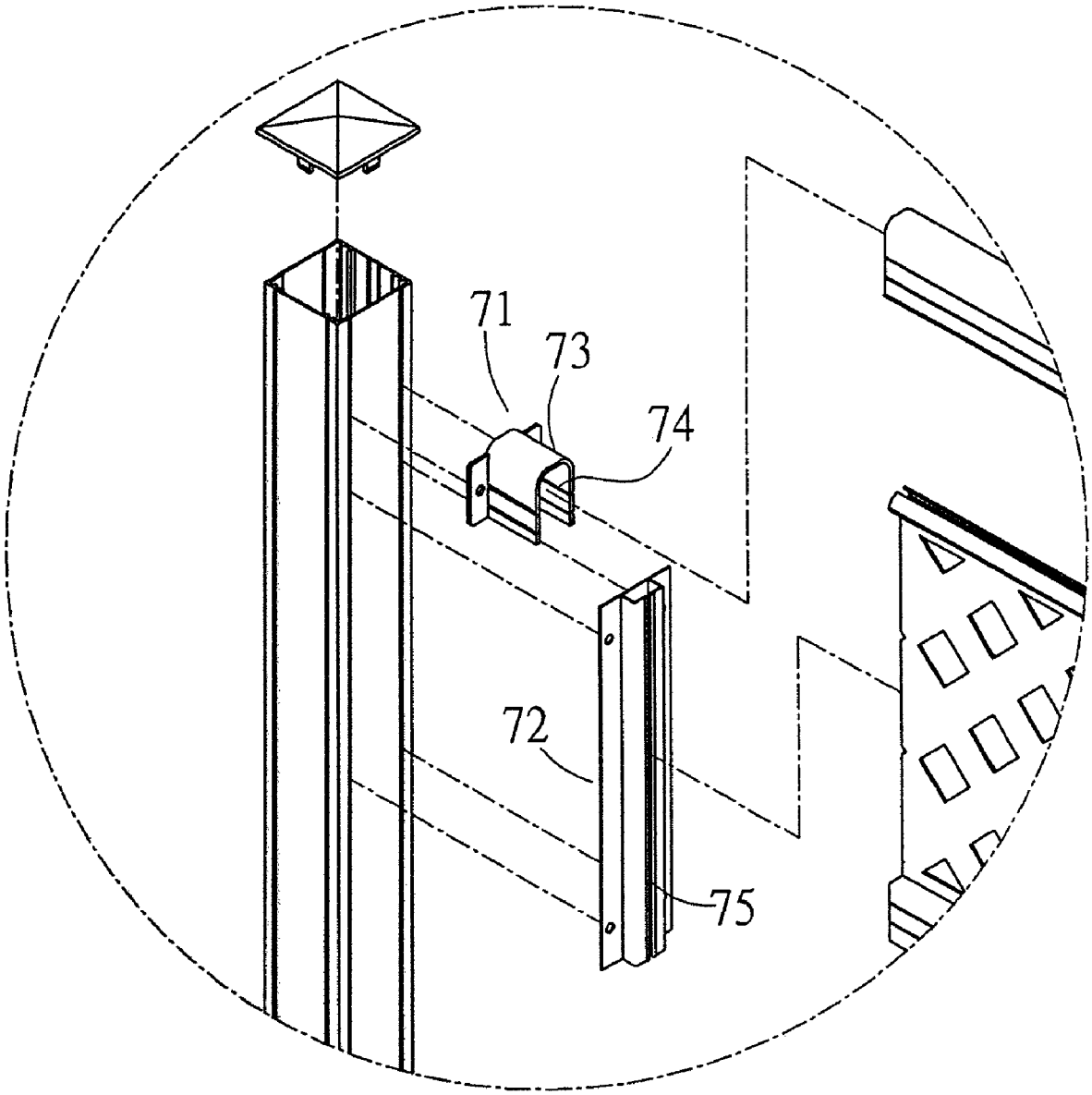
FIG. 9 is an enlarged view of part D in FIG. 8.

As shown in FIG. 9, hook 71 and buckle plate 72 are fixed to posts 61 and 62. One end of hook 71 is fixed to said posts and the other end is a gate-shaped tube 73. One long tenon 74 is set within said tube.

Said buckle plate 72 is vertical and is fixed to said posts 61 and 62 on one end. There is one crack 75 on other side of said buckle plate.

Figure 10:
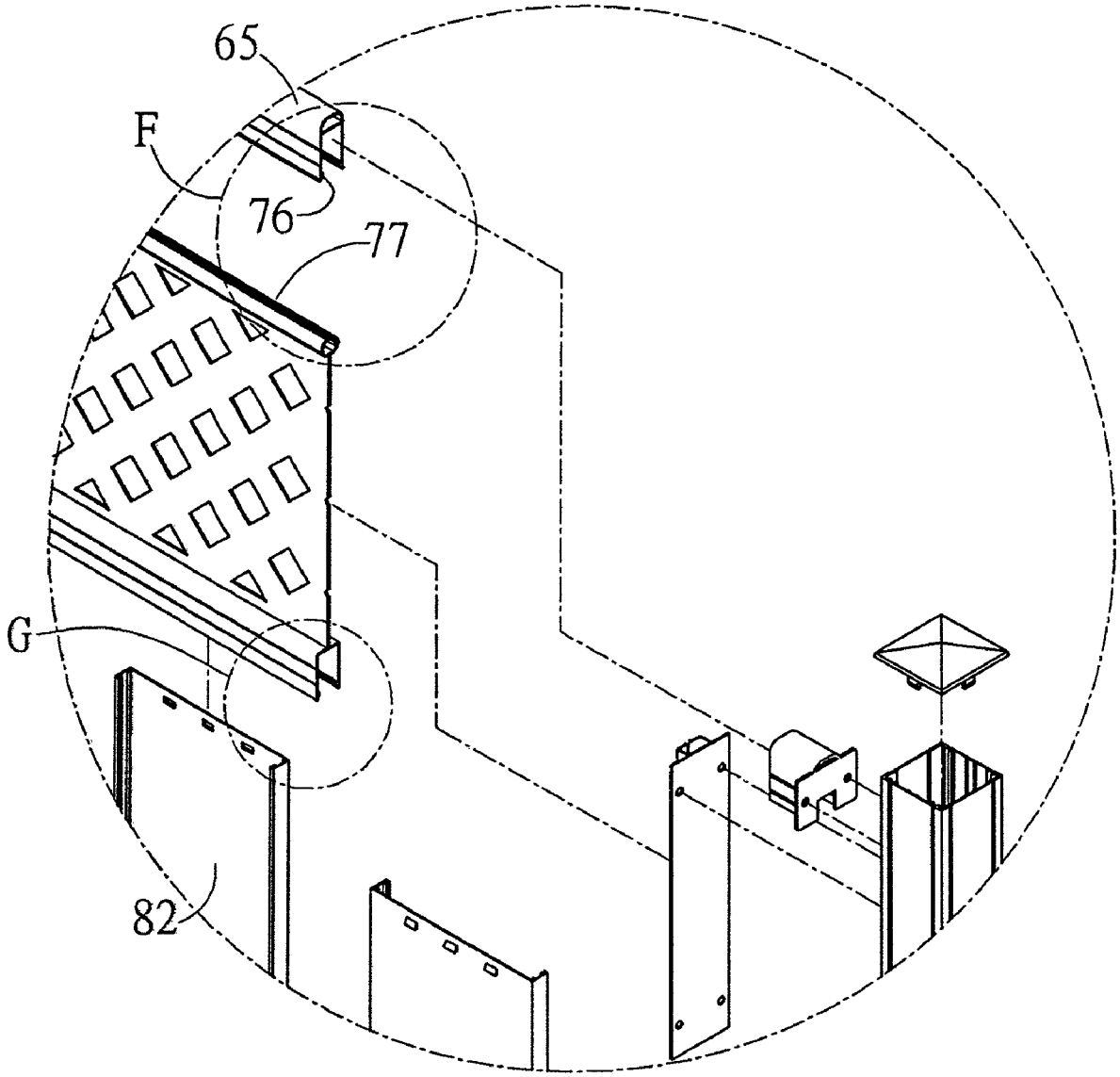
FIG. 10 is an enlarged view of part E in FIG. 8.
Figure 11:
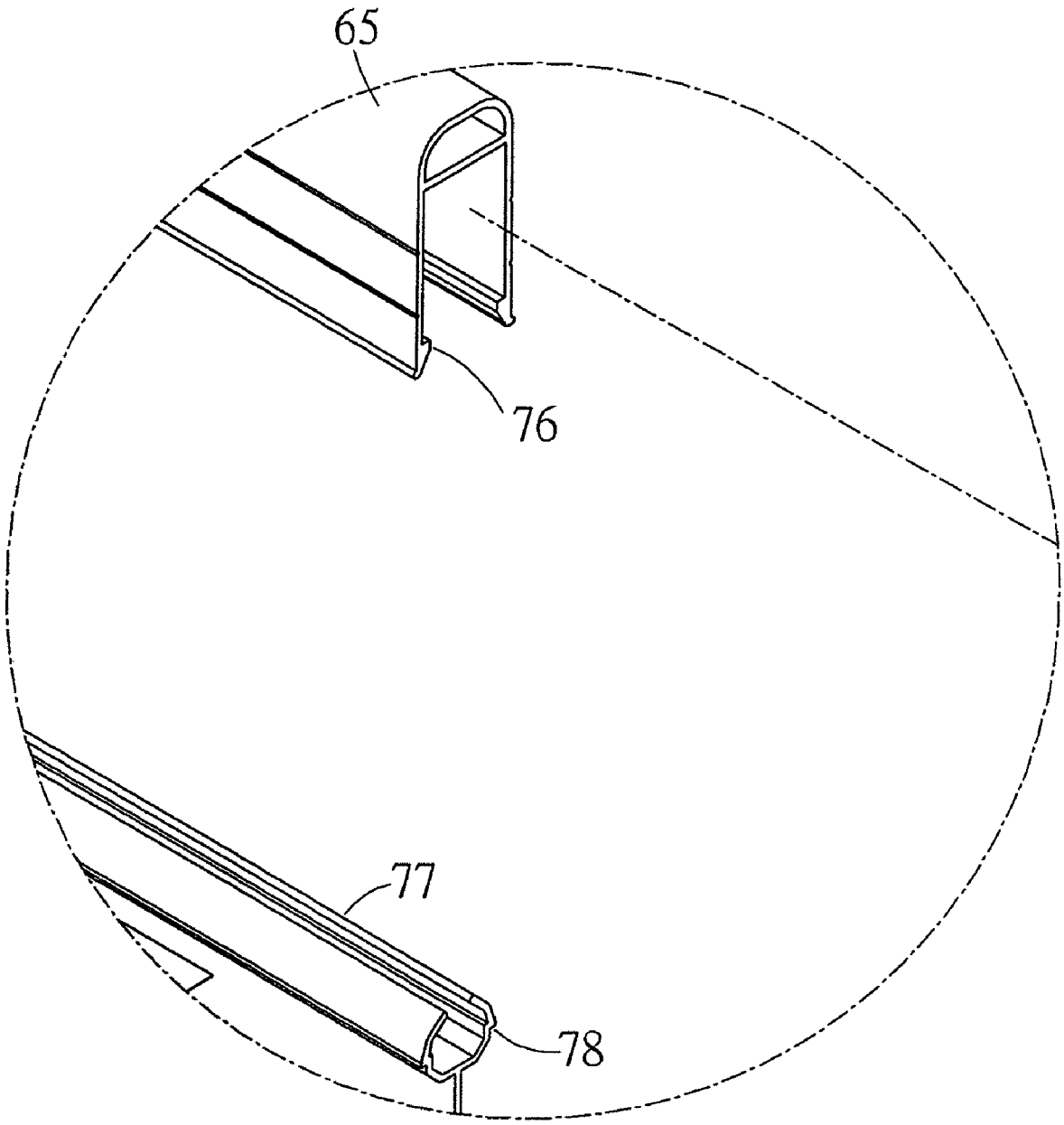
FIG. 11 is an enlarged view of part F in FIG. 10.
Figure 12:
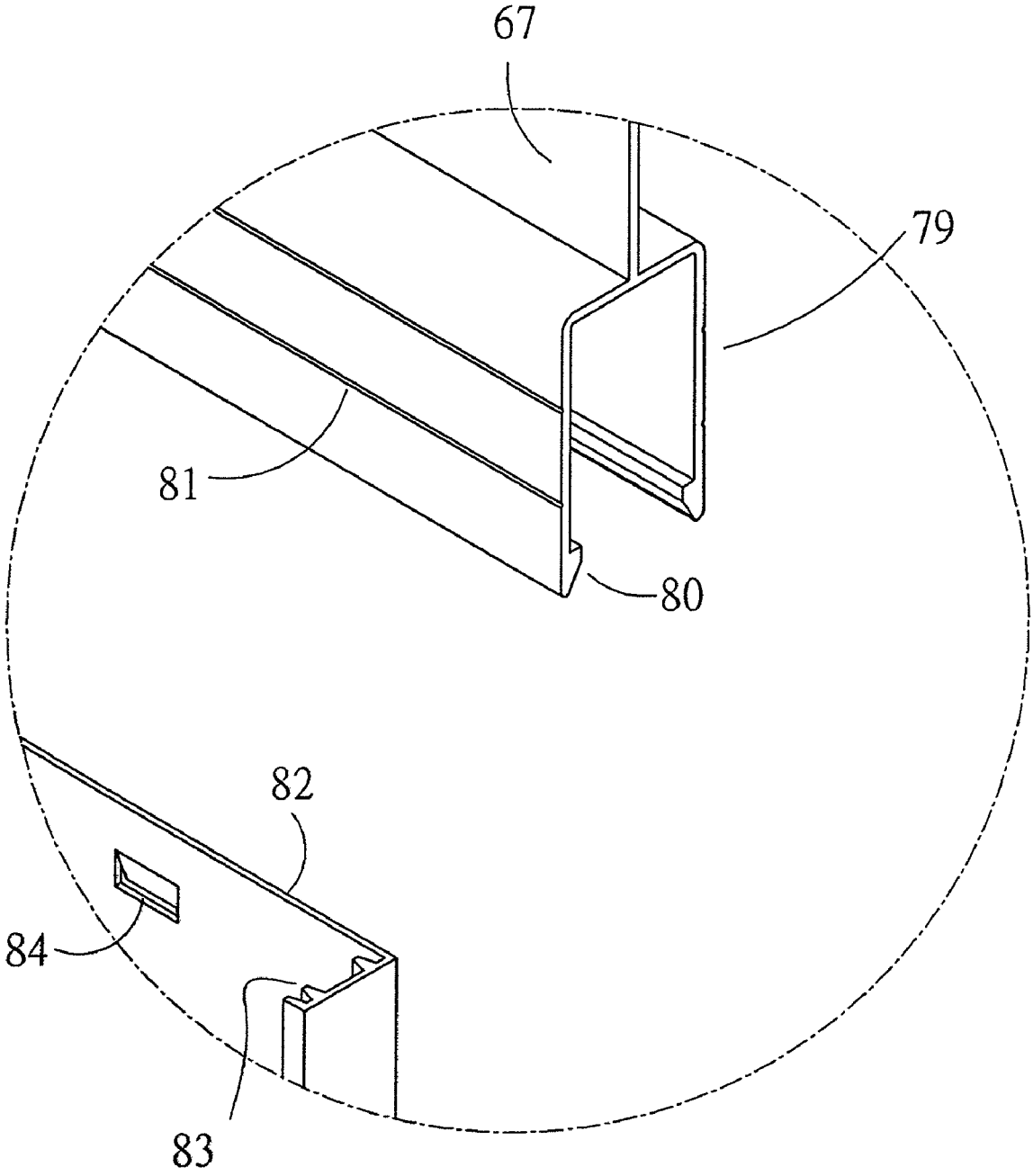
FIG. 12 is an enlarged view of part G in FIG. 10.
Figure 13:
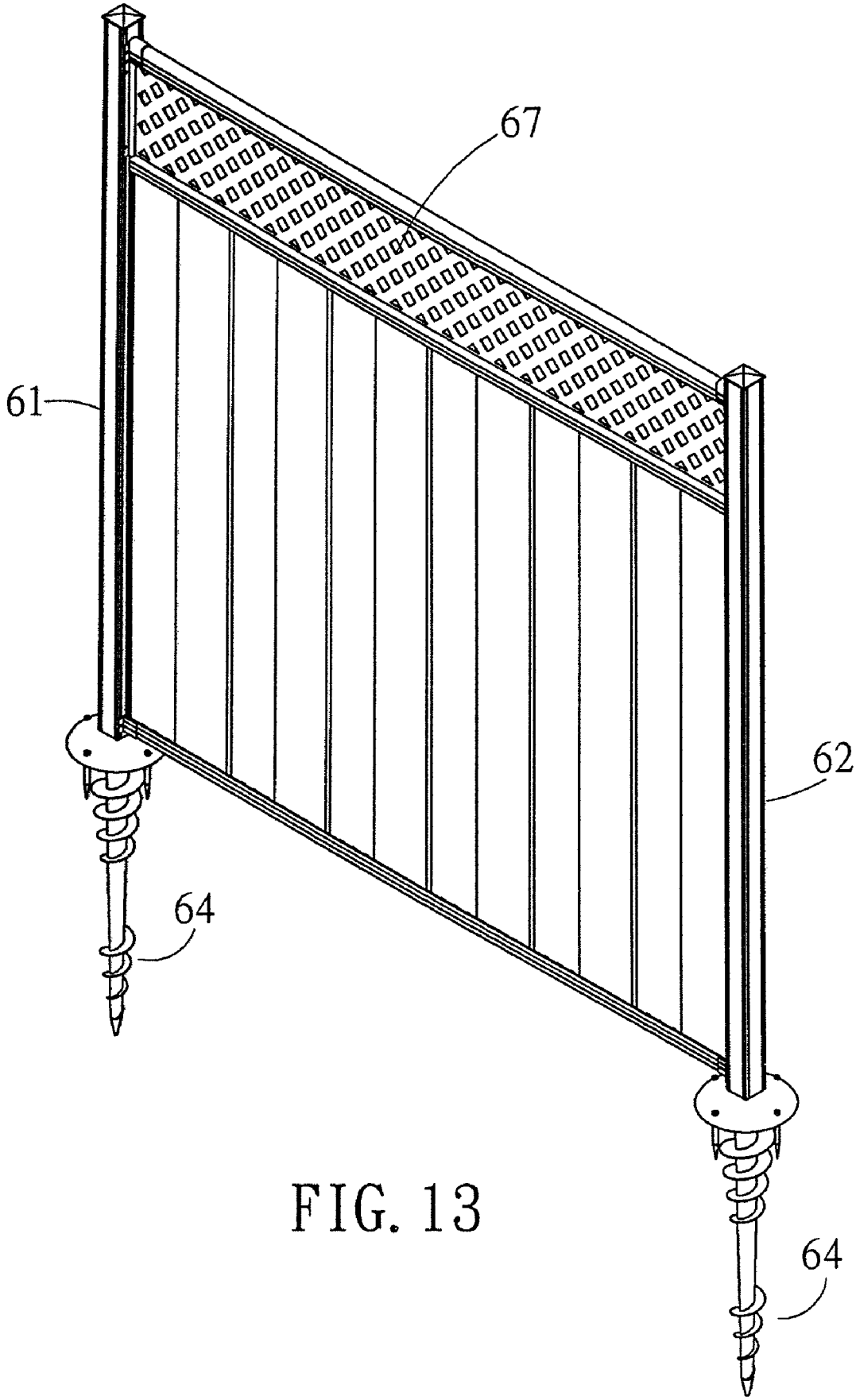
FIG. 13 is a 3-dimensional unified view of the third embodiment of the present invention.

As shown in FIGS. 10, 11, and 12, the top of said check plate 67 is formed as a C-shaped tube 77, wherein protruding trail 78 enables it to be fixed to upper beam 65. The lower part of said check plate 67 is formed as a gate-shaped tube 79, wherein intruding trail 80 and fixing line 81 enables it to be fixed to said beam. Said covering plate 68 comprise of smaller ⊏-shaped plates that are fixed to one another. The interior of said ⊏-shaped plate 82 is equipped with protruding line 83 that allows each plate to be tightly fixed to one another. On the exterior of plate 82 is protruding buckle 84, which is fixed with intruding trail 80 when said plate 82 and check plate 67 are to be fixed together.

In conclusion, from the above the components of enclosed fence/railing set of the present invention are aluminum alloy extruded, wherein they are hooked up with matching grooves and are not therefore seen in conventional enclosed fence/railing sets. Also, the present invention has not yet been made public, which is consistent with relevant Patent Law.

Although the above-mentioned embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An enclosed fence railing set, comprising:

a set of two posts comprising fixing components on both posts for engaging an upper beam and a lower beam;

a set of beams including an upper beam and a lower beam, wherein the upper and lower beams engage said fixing components, and wherein there are railings extending between said set of beams and engaged within respective longitudinal channels in said upper and lower beams;

the railings comprising:

a covering plate comprising a plurality of parallel vertical elongated C-shaped plates that are fixed to one another, and a check plate comprising a body having unitarily formed upper and lower parts, wherein the upper part of said check plate is formed with a longitudinal channel defining a C-shaped tube, the exterior of the C-shaped tube comprising folds that allow said tube to be received within said longitudinal channel in said upper beam, wherein the lower part of said check plate is formed with a longitudinal channel defining a gate-shaped tube, a lower part of said gate-shaped tube being folded inwardly to form opposed sides of the gate-shaped tube, each opposed side having an inwardly protruding trail and exterior grooves defining a protruding line that allow an upper end of each of said C-shaped plates of said covering plate to be tightly fixed to said check plate within said longitudinal channel of said gate-shaped tube, each of said C-shaped plates including a protruding buckle which is engaged with one of said protruding trails such that said C-shaped plates and said check plate are fixed together and lower ends of said C-shaped plates are received within said longitudinal channel in said lower beam; and a set of stakes for fixing said posts in a location on the ground, wherein said stakes each include an upwardly extending hollow multi-angular tube extending upwardly from said stakes and an outwardly extending plate fixed between each of said stakes and the ground, wherein each of said outwardly extending plates includes holes for the placing of nails into the ground, and wherein said hollow tubes are received within said posts to set up said posts on the ground.

2. An enclosed fence railing set as claimed in claim 1, wherein there are caps on the top of said posts, wherein the caps are conical or round in shape.

3. The enclosed fence railing set as claimed in claim 1, wherein said upper and lower beams, said check plate and said covering plate.

4. The enclosed fence railing set as claimed in claim 3, wherein each said hook is connected to one of said posts at one end and comprise a gate-shaped tube at the other end, wherein a long tenon is disposed in said gate-shaped tube of said hook for engaging an end of said upper or lower beam.

5. The enclosed fence railing set as claimed in claim 3, wherein each of said buckle plates is vertically set, with one end fixed to one of said posts and the other end comprising a crack for receiving an edge of said check plate.

6. The enclosed fence railing set as claimed in claim 1, wherein the body of said check plate, said C-shaped tube, and said gate-shaped tube are fixed with one another seamlessly.

* * * * *